United States Patent [19]

Maier

[11] Patent Number: 4,713,504

[45] Date of Patent: Dec. 15, 1987

[54] CIRCUIT BREAKER WITH HINGED ARCING CONTACT

[75] Inventor: Alfred E. Maier, Chippewa, Pa.

[73] Assignee: Westinghouse Electric Corp., Pittsburgh, Pa.

[21] Appl. No.: 7,859

[22] Filed: Jan. 28, 1987

Related U.S. Application Data

[63] Continuation-in-part of Ser. No. 835,667, Mar. 3, 1986.

[51] Int. Cl.[4] ..... H01H 33/12
[52] U.S. Cl. ..... 200/146 R
[58] Field of Search ..... 200/146 R

[56] References Cited

U.S. PATENT DOCUMENTS 3,585,329 6/1971 Walker et al. ..... 200/146 R
3,662,134 5/1972 Cellerini ..... 200/146 R

*Primary Examiner*—Robert S. Macon
*Attorney, Agent, or Firm*—L. P. Johns

[57] ABSTRACT

A circuit breaker with hinged arcing contact characterized by an insulating housing enclosing a circuit breaker mechanism, an electromagnetic trip device therefor, separable contact means including stationary contacts and movable main and arcing contacts and the arcing contacts being pivotally mounted on the main contacts whereby the arcing contacts are forced against the stationary contacts as the main contacts open.

7 Claims, 4 Drawing Figures

CIRCUIT BREAKER WITH HINGED ARCING CONTACT

CROSS-REFERENCE TO RELATED APPLICATION

This application is a continuation-in-part of copending U.S. patent application Ser. No. 835,667, filed Mar. 3, 1986.

BACKGROUND OF THE INVENTION

1. Field of the Invention

This invention relates to circuit breakers and, more particularly, it pertains to an arcing contact hingedly mounted for reducing arcing between separating contacts.

2. Description of the Prior Art

Circuit breakers are used in industrial, commercial, and residential applications to provide protection for electrical apparatus and distribution circuits. Upon overcurrent conditions through a connected electrical circuit, the circuit breaker automatically opens to interrupt electric current flow to the circuit. Some circuit breakers utilize direct tripping operation wherein a circuit current flowing through the breaker also flows through a device, such as a bimetal or an electromagnet, to directly actuate a latch mechanism. In multiple circuit breakers employing direct tripping operation, a separate trip mechanism is often employed for each pole.

Overcurrent conditions through any pole of the circuit breaker cause the associated trip device to function, effecting separation of the contacts of that pole. Since it is generally desirable to have all poles of the circuit breaker trip at the same time, such circuit breakers employ a trip bar or other means connecting the various poles of the circuit breaker to provide simultaneous tripping operation of all poles.

Associated with the foregoing is the problem of arcing between contacts when the contacts separate to open a circuit through the circuit breaker. Arcing deteriorates the contacts. Prior circuit breaker structures having high current ratings had hinge rather than shunt connection, but there was no toeing and heeling action between the separating contacts as in lower rated circuit breakers. The disadvantage of such structure has been that it carried current continuously in the same contact area where the current was also interrupted, thus adding to the deterioration of the contacts.

SUMMARY OF THE INVENTION

In accordance with this invention, a circuit breaker is provided which comprises movable contact means and stationary contact means; the movable contact means including a movable main contact and a movable arcing contact; a contact carrier structure having a contact arm carrier and a plurality of contact arms; the plurality of contact arms being pivotally mounted on a first pivot; an operating structure for moving the contact carrier structure between open and closed positions of the movable and stationary contact means; the contact arms including a plurality of substantially parallel space contact arms and having a movable main contact on each arm; at least one of the parallel spaced contact arms supporting an arcing contact structure pivotally mounted on a second pivot on the arm, the second pivot being spaced from the first pivot; the arcing contact being biased by spring means toward the stationary contact means so as to remain in momentary contact with the stationary contact means until after the movable main contact disconnects therefrom; an adjustable set screw in the contact arm carrier and extending toward the arcing contact structure for retaining the arcing contact structure in said momentary contact; and the contact arm supporting an arcing contact structure comprising a notch having notch-forming surfaces and the arcing contact structure being pivotally mounted in the notch and having surface-to-surface contact with one of said notch-forming surfaces when the arcing contact structure is in momentary contact with the stationary contact means.

The device of this invention has the advantage of providing an arcing contact which is hinged on the main contact so that the current carried by the arcing contact travels through the main contact before going to the load conductor. This enables the use of more main contacts, resulting in increased rating for a given width of circuit breaker. Moreover, where the main contacts are blown open, in response to overload current, the arcing contact is forced against a stationary arcing contact which ensures transfer of the current to the arcing contact, thereby eliminating deterioration of the main contacts.

DESCRIPTION OF THE PREFERRED EMBODIMENT

Figure 1:
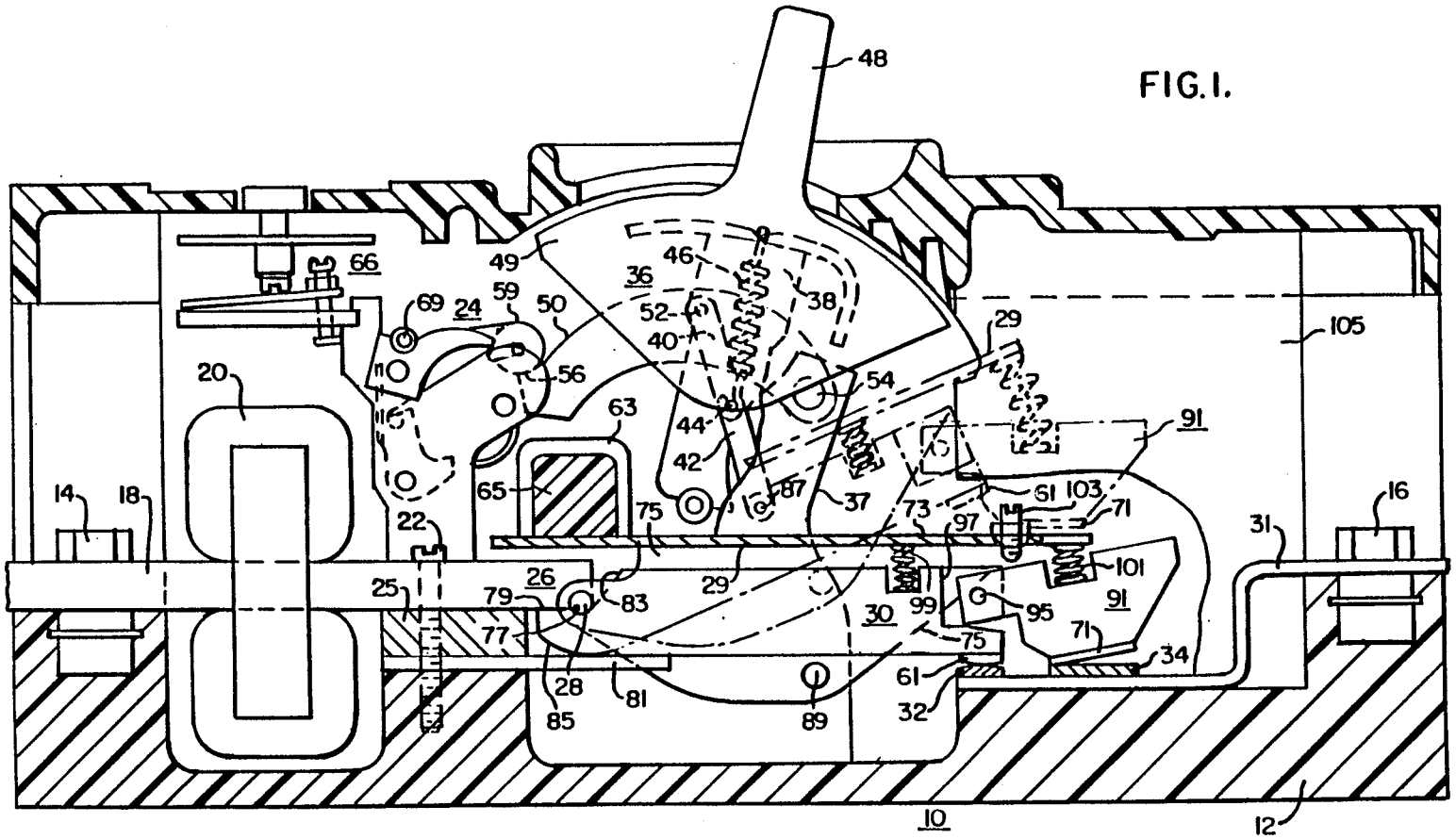
FIG. 1 is a vertical sectional view, taken on the line I—I of FIG. 2, showing a circuit breaker in the closed circuit condition.

In FIG. 1, a circuit breaker is generally indicated at 10 and it is contained within a molded case for insulating housing 12. The circuit breaker 10 is of the type more specifically described in U.S. Pat. No. 3,585,329, issued June 15, 1971 to Eugene J. Walker, James P. Ellsworth, and Alfred E. Maier. Thus, only a brief description of the circuit breaker per se is set forth herein. The housing 12 is separated into three components containing three pole units of the multi-pole circuit breaker in a manner well known in the art. In each pole unit, a pair of terminals 14, 16 are provided at opposite ends of the compartment to enable connection of the circuit breaker to an electric circuit.

Figure 2:
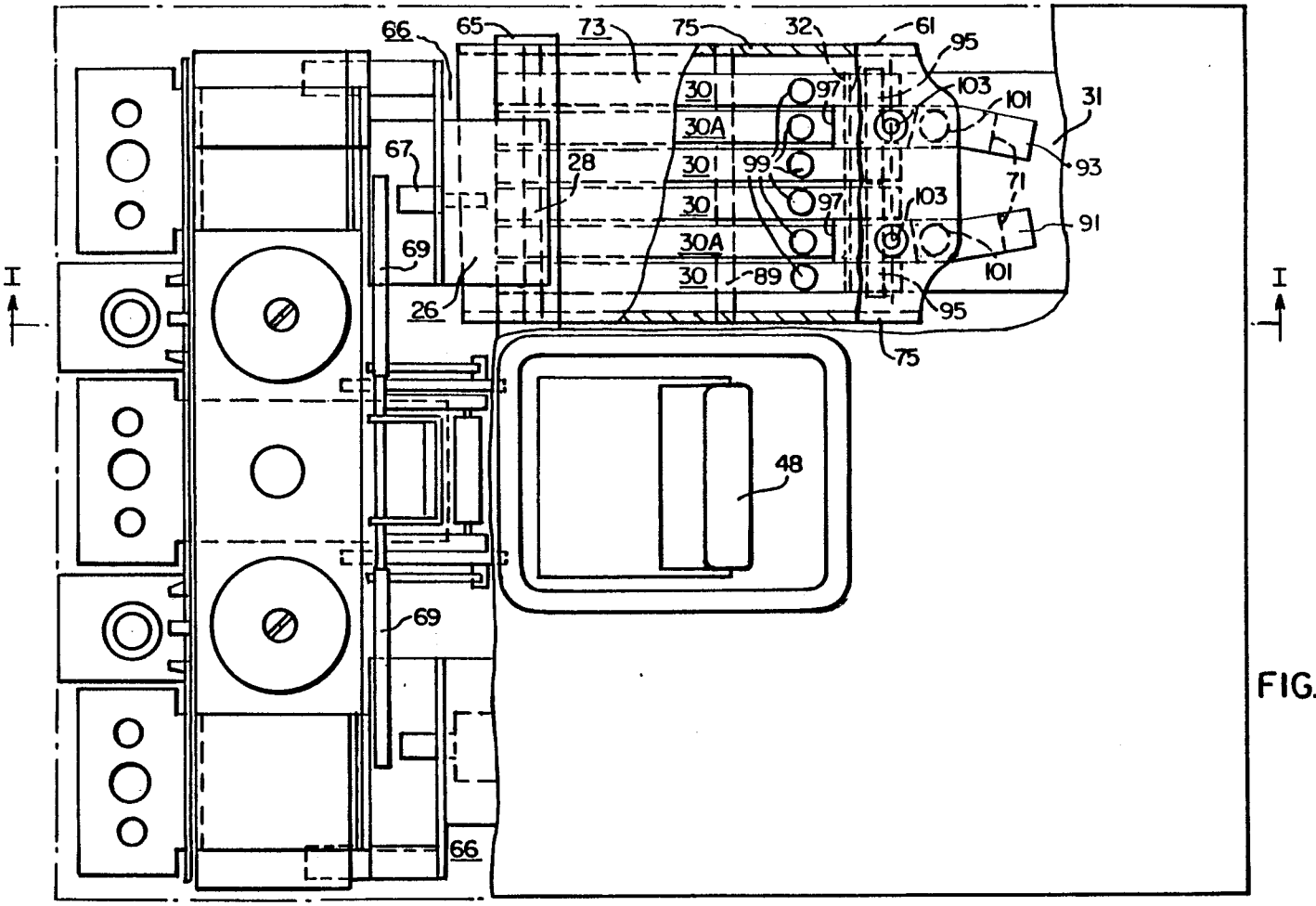
FIG. 2 is a plan view with a portion broken away showing the circuit breaker as a three-pole structure.

In each of the pole unit compartments, a rigid stationary conductor 18 extends through a current transformer 20. A mounting screw 22 extends through a latch mechanism 24 and through a copper conductor 25 into the housing 12. At its right end (FIG. 1), the conductor 18 is electrically connected to a contact carrier structure 26 at a pivot 28. The contact carrier structure 26 includes a contact arm carrier 29 and a plurality of spaced parallel contact arms 30 (FIG. 2). Each pole unit includes a rigid conductor 31 connected at one end to the terminal 16 and supporting at the other end thereof fixed contact means including a stationary main contact 32 and a stationary arcing contact 34. Though two contacts 32 and 34 are shown, they may be combined into one long contact unit on the conductor 31.

A single operating mechanism 36 for controlling all three circuit poles is mounted in the center pole unit of the circuit breaker. The operating mechanism 36 comprises a frame 37 including spaced supporting plate parts mounted on the base of housing 12, a pivoted forked operating lever 38, upper and lower toggle links 40, 42 which are pivotally connected by means of a knee pin 44, a pair of tension springs 46, and a movable insulating handle 48. The upper toggle link 40 is pivotally connected to a movable releasable arm or cradle 50 by a pin 52. The releasable cradle 50 is pivotally supported on the frame 37 by a pivot pin 54. The other end of the releasable cradle 50 includes a latch surface 56 which is held in a latched position by a primary latch lever or roller 59. The roller is part of the latch mechanism 24.

With the terminals 14, 16 connected to an electric circuit, a current path through the circuit breaker flows from the terminal 14 through the conductor 18, pivot 28, contact arms 30, movable main contacts 61, stationary main contacts 32, and the conductor 31 to the terminal 16. The handle 48 is operable to move the contact arm carrier 29 between the closed (solid line) position and the open (broken line) position in a well-known manner. The contact arm carrier 29 includes a staple 63 which is secured about a molded insulating cross bar 65, connecting the contact carriers of each pole unit.

The current transformer 20 is connected to solid state electronic circuitry (not shown) which is in turn connected to a flux transfer trip mechanism 66 mounted within one of the outside pole unit compartments (FIG. 1). The flux transfer trip mechanism 66 is of the type described more completely in U.S. Pat. No. 3,783,423, issued Jan. 1, 1974 to Alfred E. Maier, et al. Overcurrent conditions through any of the pole units will be detected by the corresponding current transformer 20, the outlet signal of which is then processed by the electronic circuitry to activate the flux transfer mechanism 66 (FIG. 2). This causes a plunger 67 to move against a trip bar 69 to thereby actuate the latch release mechanism 24, thereby releasing the releasable arm or cradle 50 to move the contact arms 30 to the broken line position (FIG. 1). The foregoing operation is set forth more particularly in U.S. Pat. No. 4,123,734.

In accordance with this invention, the contact carrying assembly including the contact arm carrier 29 and contact arms 30 function to avoid arcing between the movable contacts 61 and main contacts 32 by the use of a stationary arcing contact 34 and a movable arcing contact structure having an integral arcing contact 71. The contact arm carrier 29 is an inverted U-shaped member including a bight portion 73 (FIG. 2) and a pair of spaced down-turned flanges 75 between which the contact arms 30 are disposed. The flanges 75 and contact arms 30 are pivotally mounted on the pivot 28. Each contact arm 30 includes a U-shaped groove 77 (FIG. 1) and a surface 79 which are in surface-to-surface contact with the pivot 28 and the undersurface of the conductor 18, respectively, where they are retained in place by a brace 81 secured to the housing 12 by the screw 22 extending through the conductors 18 and 25. When the assembly of the contact arm carrier 29 and the arms 30 rotate counterclockwise about the pivot 28, inclined end surfaces 83 on the arms provide clearance between the arms and the end of the conductor 18. Similarly, the arms 30 include curved surfaces 85 for turning against the brace 81 as the rotation occurs. Thus, the contact arms 30 remain in good electrical contact with the conductor 18, and the brace 81.

As shown in FIG. 1, the lower end of the lower toggle link 42 is pivotally connected at 87 to the bight portion 73 of the contact carrier 29. When the toggle is actuated to lift the contact carrier 29 counterclockwise to open the circuit between the contacts, a pin 89 extending between the lower parts of the spaced flanges 75 lifts the contact arms 30 to the broken line position **30*a* shown in FIG. 1**.

The several contact arms 30 are disposed in spaced parallel relationship (FIG. 2) for supporting the movable contacts 61 in place above the main contact 32. At least one and preferably two arcing contact structures 91, 93 (FIGS. 1, 2) are pivotally connected by similar pins 95 on the contacts arms 30A. For that purpose, each of the contact arms 30A includes an end notch 97 in which the structures 91, 93 are located for pivotal movement. The pivot pins 95 extend through end openings in the adjacent contact arms 30 on each side of each notched contact arm 30A. The two arcing contact structures 91, 93 are slightly thicker than the contact arms 30A in order to provide a snug-fitting, electrical contact between the structures and adjacent arms 30. Moreover, each notch 97 includes a notch-forming surface 98 which is in surface-to-surface contact (FIG. 3) with a corresponding surface 100 of the structure, thereby maintaining good electrical contact between the arms 30A and structure 91, 93 when in the position of FIG. 3. The circuit path extends from the contact arms 30 and 30A and through the structures 91, 93 and the arcing contact 71, to the arcing contacts 34. Each contact arm 30 is biased away from the contact arm carrier 29 by a coil spring 99, and the force of the coil spring 99 provides pressure on the contact arms 30 for maintaining good electrical contact between the contacts 32, 61. Similarly, each structure 91, 93 is biased away from the contact arm carrier 29 by separate coil springs 101.

Figure 3:
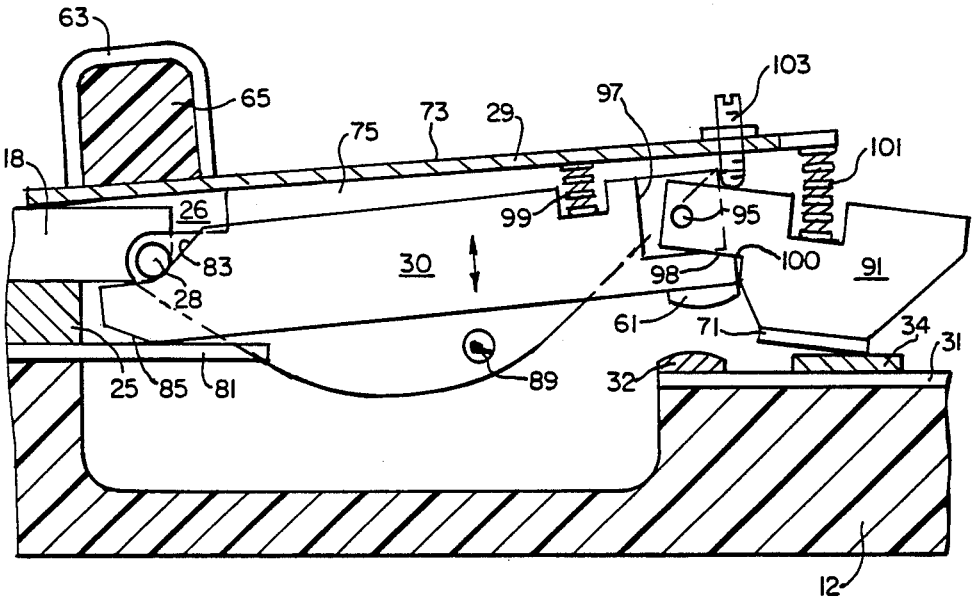
FIG. 3 is a fragmentary view showing the contacts in an intermediate position.

When a significant overcurrent condition occurs, the main contacts 32, 61 are blown open, or separate, to a momentary position as shown in FIG. 3. In that position the trip mechanism 66 has not yet tripped so that the contact arm carrier 29 is still in the closed-contact position. As shown in FIG. 3 stop means, such as an adjustable set screws 103, extend from the bight portion 73 of the contact arm carrier 29 toward the arcing contact structures 91, 93 (FIGS. 1, 2). As the contacts 32, 61 separate the top surfaces of the structures 91, 93 strike the set screws 103 in order to hold the arcing contacts 71 in delayed engagement with the stationary arcing contacts 34 (FIG. 3). Thus the arcing contacts 71 move away from the arcing contacts 34 after the main contacts 32, 61 have separated, whereupon arcing occurs between the arcing contacts 34, 71 rather than between the main contacts 32, 61.

Figure 4:
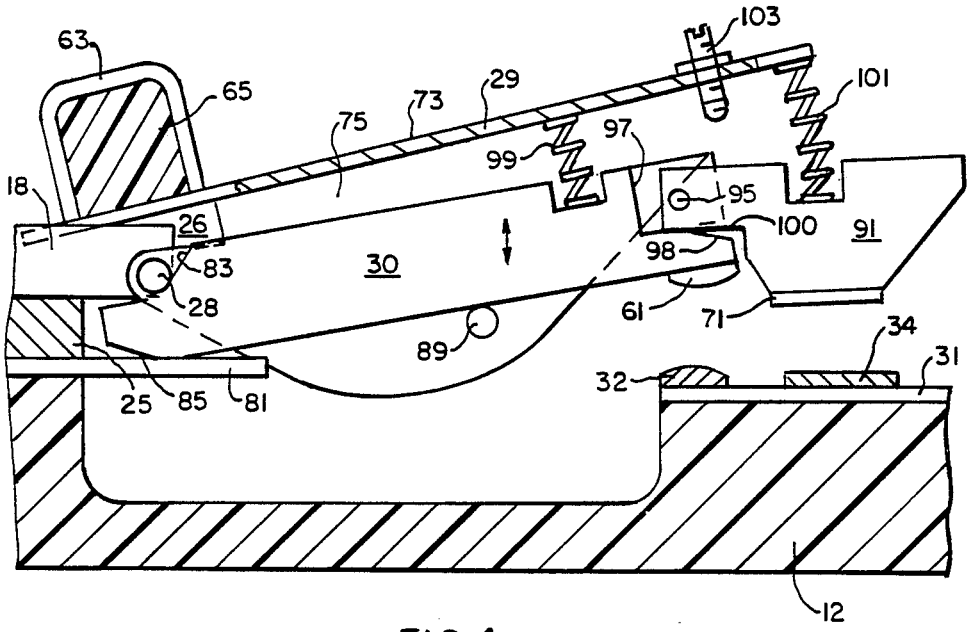
FIG. 4 is a fragmentary view showing the contacts in the open circuit condition.

Subsequently, the breaker trips and, as the contact carrier assembly reaches the fully open (FIG. 4), the arc is extinguished within an arc chute 105 in a conventional manner. In each arc chute for each pole unit, the converging positions of the support arms 91, 93 force the arcs into the arc chutes 105.

In conclusion, the device of this invention embodies arcing contacts which are hinged on main contacts so that current carried by the arcing contacts travels through the main contacts before going to load conductors. This enables the use of more main contacts and if the main contacts "blow off", the arcing contacts are forced against the stationary arcing contacts which ensures transfer of the current to the arcing contacts.

What is claimed is:

1. A circuit breaker with arcing contacts comprising:

separable contact means including movable contact means and stationary contact means;

the movable contact means including a movable main contact and a movable arcing contact;

a contact carrier structure comprising a contact arm carrier and a plurality of parallel spaced contact arms;

the plurality of contact arms being pivotally mounted on a first pivot;

an operating mechanism for moving the contact carrier structure between open and closed positions of the movable and stationary contact means;

each contact arm comprises a movable main contact;

at least one of the parallel spaced contact arms supporting an arcing contact structure pivotally mounted on a second pivot on the arm, the second pivot being disposed between the first pivot and the arcing contact;

the arcing contact structure being biased toward the stationary contact means so as to remain in momentary contact with the stationary contact means until after the movable main contact disconnects therefrom; and stop means between the contact arm carrier and the arcing contact structure and between the second pivot and the arcing contact for retaining the arcing contact structure in momentary contact with the stationary contact means, whereby any contact arcing occurring is diverted from the movable main contact.

2. The circuit breaker of claim 1 in which the stop means comprises a set screw adjustably mounted for holding the arcing contact structure in momentary contact with the stationary contact means.

3. The circuit breaker of claim 2 in which the set screw is adjustably mounted in the contact arm carrier and extends toward the arcing contact structure.

4. The circuit breaker of claim 3 in which the arcing contact is biased by spring means extending between the contact carrier and the arcing contact structure.

5. The circuit breaker of claim 4 in which the set screw is disposed in substantial alignment with the movable main contact and the stationary contact means for maintaining good electrical contact.

6. The circuit breaker of claim 5 in which the plurality of contact arms are mounted for limited pivotal movement within the contact arm carrier.

7. The circuit breaker of claim 6 in which each contact arm supporting an arcing contact structure comprises a notch having notch-forming surfaces and the arcing contact structure being pivotally mounted within the notch and is in surface-to-surface contact with one of said notch-forming surfaces when the arcing contact structure is in momentary contact with the stationary contact means.

* * * * *